United States Patent [19]

Bass et al.

[11] 4,291,884

[45] Sep. 29, 1981

[54] BOARD GAME APPARATUS AND METHOD OF PLAYING

[75] Inventors: Sidney Bass, Los Angeles; Gary W. Pimentel, Fountain Valley, both of Calif.

[73] Assignee: Mattel, Inc., Hawthorne, Calif.

[21] Appl. No.: 103,140

[22] Filed: Dec. 13, 1979

[51] Int. Cl.[3] ..... A63F 3/00

[52] U.S. Cl. ..... 273/249; 273/288

[58] Field of Search ..... 273/1 G, 1 GC, 288, 273/289, 248, 249, 243, 236, 276

[56] References Cited

U.S. PATENT DOCUMENTS

| | | | |
|---|---|---|---|
| 3,608,903 | 9/1971 | Cooper et al. | 273/236 X |
| 3,708,168 | 1/1973 | Strader et al. | 273/1 G |
| 3,754,763 | 8/1973 | Breslow | 273/243 |
| 3,841,628 | 10/1974 | Goldfarb | 273/1 GC |
| 4,089,527 | 5/1978 | Roth | 273/249 |
| 4,120,503 | 10/1978 | Macrory et al. | 273/248 X |
| 4,159,117 | 6/1979 | Kuna | 273/243 |

FOREIGN PATENT DOCUMENTS

| | | | |
|---|---|---|---|
| 731048 | 8/1932 | France | 273/289 |

*Primary Examiner*—Richard C. Pinkham
*Assistant Examiner*—Scott L. Brown
*Attorney, Agent, or Firm*—Reagin & King

[57] ABSTRACT

A game construction including a game board having a plurality of positions to be occupied by playing pieces belonging to different players, the positions during a path to be followed from a start to a finish. The game has a number of different identifiable playing pieces which are molded from a pliable material. Various ones of the positions are identified with the different ones of the playing pieces, and a piece landing on a position identified as that of another player is flattened by the owner of the space. The degree of flattening caused is measured to determine later movements of the piece on the game board.

5 Claims, 4 Drawing Figures

BOARD GAME APPARATUS AND METHOD OF PLAYING

BACKGROUND OF THE INVENTION

This invention relates to games and, more particularly, to board games having a game path to be negotiated by playing pieces.

There have been many board games devised over the years. Most of these games involve players each of whom moves an individual piece along a game path to a game end, the player having the first piece to arrive at such end being the winner. Such prior art games normally have a means for selecting moves to be made by the pieces which involve both chance and strategic skill. It is unusual, however, for a board game to require manipulative skill to be exercised by the individual players even though such skill requirement would enhance the play value of the game.

In most prior art board games the play pieces may vary in size or shape from one another but each piece remains fixed in both size and shape throughout the game. An additional degree of excitement could be injected into such games were the size or shape of the play pieces to vary during the game and the outcome depend upon that size or shape.

It is an object of the present invention to provide a new and unique board game which utilizes the manipulative ability of the players in deciding the outcome of the game.

It is another object of the present invention to provide a new and improved board game in which size and shape of the characters changes during the game depending on the physical ability of the players involved.

It is still another object of this invention to provide a new board game which utilizes playing pieces which may be molded to various shapes from a pliable material and have their shapes changed during the play of the game by physical manipulation by the players, the shape of the piece determining to some extent the outcome of the game.

SUMMARY OF THE INVENTION

The foregoing and other objects of the invention are accomplished by a board game which has a plurality of positions which are to be occupied by playing pieces belonging to different players. The positions define a game path to be followed from a start to a finish. A selecting device which depends upon chance determines the length of each move to be made by each player. A number of different identifiable playing pieces are molded from a pliable material by the players and individual board spaces are identified with individual ones of the pieces. If a player lands on a board space belonging to another player, his piece is flattened by the other player hitting the piece. The board also contains positions which require that the size of pieces be measured and that certain actions be taken depending upon the size of pieces landing thereon. Consequently, the size to which a piece has been flattened and widened becomes determinative of a player's movement along the game path and the ability to flatten another player's piece becomes important.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
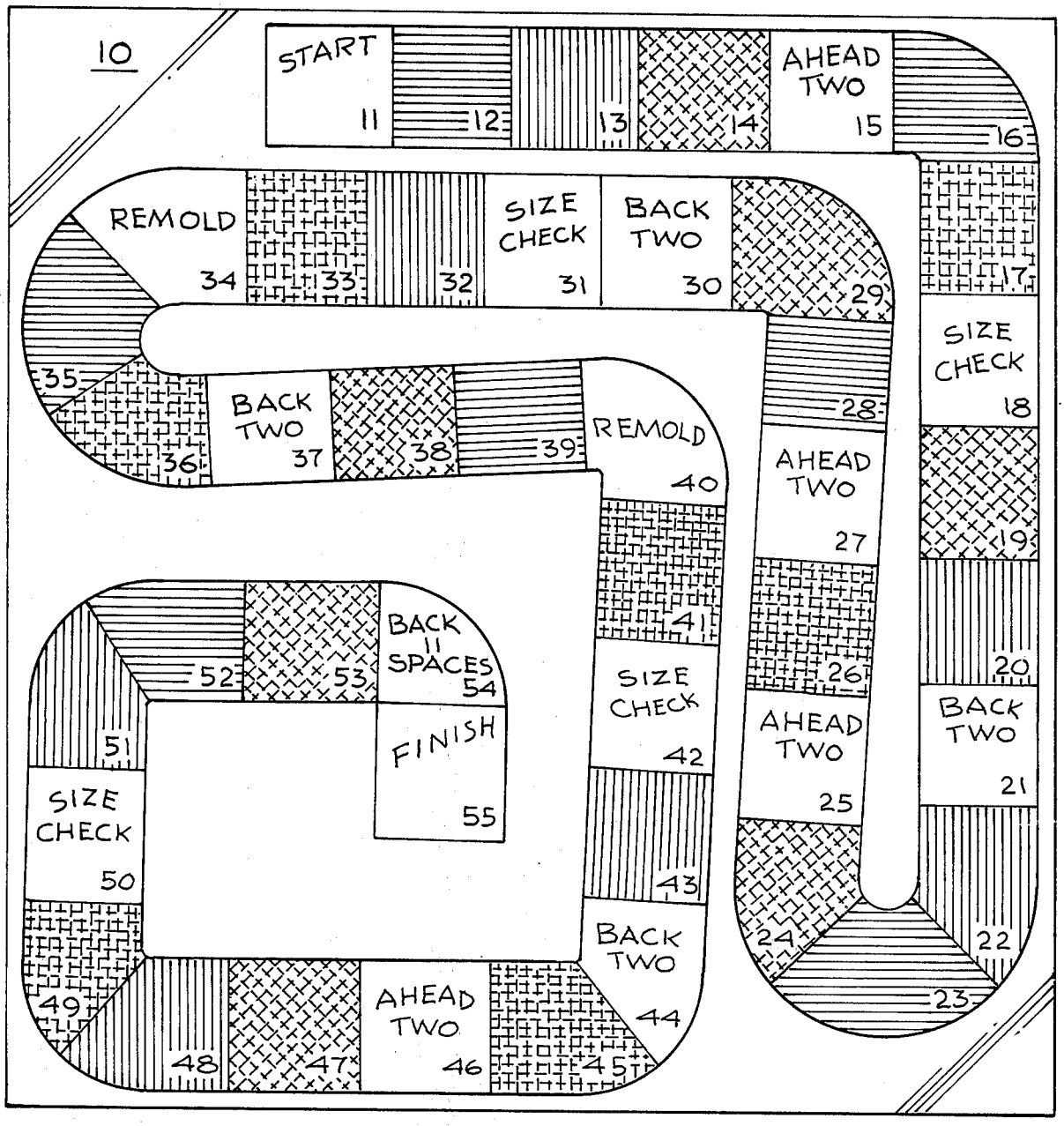
FIG. 1 is a top view of a game board which is a part of the present invention.

Referring now to the drawings and, more particularly, to FIG. 1, there is shown a playing board 10 for a game constructed in accordance with the invention. The playing board 10 has arranged thereon a number of positions 11 through 55 which define a game path which proceeds from a start at position 11 to a finish at position 55. In the preferred embodiment various of the positions are identified with playing pieces by being colored to match the color of the individual playing pieces. For example, spaces numbered 13, 20, 22, 32, 43, 48, and 51 may be colored purple in a preferred embodiment to match the color of a purple piece utilized by one of the players. In like manner, various other positions may be colored blue, yellow, and orange in a preferred embodiment to match other individual playing pieces.

In order to lend excitement to the game, various of the other positions direct players landing pieces thereon to move those pieces to other positions. For example, position 15 is labeled "ahead two" so that a player landing his piece thereon moves that piece ahead two more positions to position 17. The same sort of game enhancement is provided by squares 21, 25, 27, 30, 37, 44, 46, and 54 which direct players to move their pieces "ahead" and "back" by varying amounts. Other designations of moves might be made without modifying the philosophy of the play of the game substantially.

The board 10 also includes positions 18, 31, 42, and 50 which are identified as "size check" positions. These are used in association with the positions 34 and 40 which are labeled "remold" to provide the unique form of play to this particular game, as will be explained hereinafter.

Figure 2:
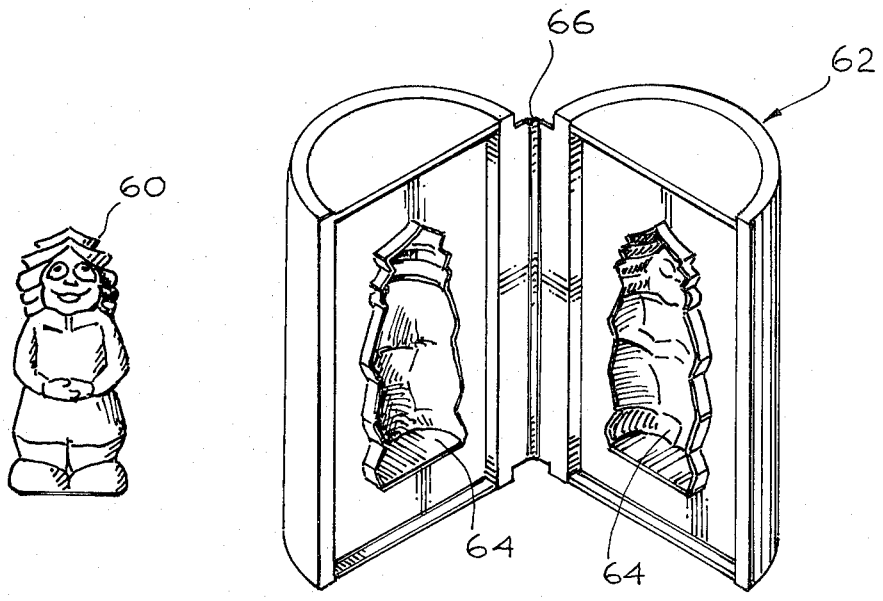
FIG. 2 is a perspective view showing a mold for shaping pliable material into the playing pieces used in the present invention.

Referring now to FIG. 2 there is shown a playing piece 60 which in the preferred embodiment is shaped by a mold 62 from a material such as moldable clay. The mold 62 has two recessed cavities 64 separated by a hinge 66 about which the cavities 64 may be pivoted so that when clay or other moldable material is placed therein and the cavities are brought together a shaped playing piece 60 will be produced. The mold 62 may be constructed of a relatively hard plastic material such as acrylonitrile-butadiene-styrene which is inexpensive and may be molded into a hard smooth interior surface shaped to provide a playing piece of appropriate exterior finish.

Figure 3:
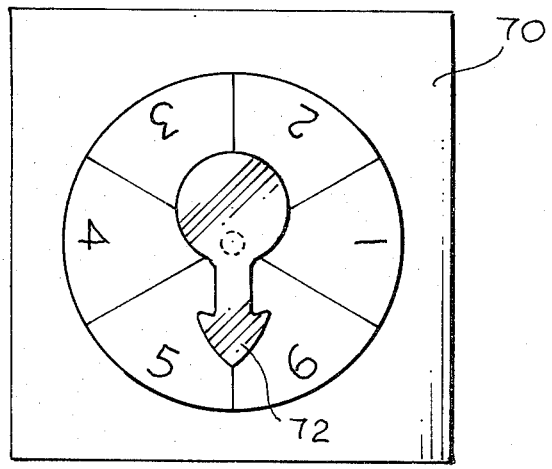
FIG. 3 is a diagramatic view of a spinner used to determine moves to be made in playing the game of this invention.
Figure 4:
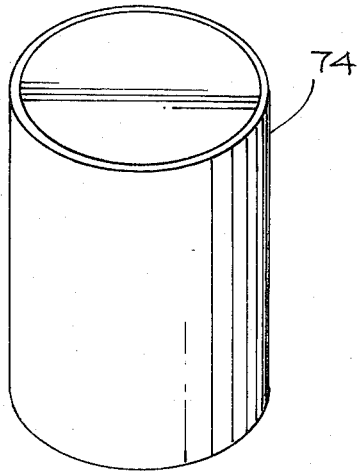
FIG. 4 is a perspective view showing a mallet utilized to flatten the playing pieces in playing the game of this invention.

Another part of the preferred embodiment of the game of this invention is a spinner shown in FIG. 3 which is utilized in playing to select the length of moves to be made by the players. The spinner is of a well known type having, in the preferred embodiment, six